US006241488B1

(12) United States Patent
Luoto

(10) Patent No.: US 6,241,488 B1
(45) **Date of Patent: *Jun. 5, 2001**

(54) MULTI-PISTON HYDRAULIC PUMP FOR A FREE PISTON ENGINE

(75) Inventor: Mikko Luoto, Vantaa (FI)

(73) Assignee: Sampower Oy, Hämeenlinna (FI)

( * ) Notice: Subject to any disclaimer, the term of this patent is extended or adjusted under 35 U.S.C. 154(b) by 0 days.

This patent is subject to a terminal disclaimer.

(21) Appl. No.: 08/669,290

(22) PCT Filed: Dec. 27, 1994

(86) PCT No.: PCT/FI94/00584

§ 371 Date: Feb. 12, 1999

§ 102(e) Date: Feb. 12, 1999

(87) PCT Pub. No.: WO95/18305

PCT Pub. Date: Jul. 6, 1995

(30) Foreign Application Priority Data

Dec. 28, 1993 (FI) ..... 935892

(51) Int. Cl.[7] ..... F02B 71/00; F04B 17/05

(52) U.S. Cl. ..... 417/396; 123/46 R

(58) Field of Search ..... 123/46 R; 417/364, 417/396

(56) References Cited

U.S. PATENT DOCUMENTS

| | | | | |
|---|---|---|---|---|
| 2,503,152 | * | 4/1950 | Ekblom | 417/396 |
| 2,739,671 | * | 3/1956 | Edge et al. | 417/396 |
| 3,089,305 | * | 5/1963 | Hobbs | 417/396 |
| 3,149,773 | * | 9/1964 | Cudahy | 417/396 |
| 3,986,796 | * | 10/1976 | Moiroux et al. | 417/396 |
| 4,087,205 | * | 5/1978 | Heintz | 417/396 |
| 4,097,198 | | 6/1978 | Herron . | |
| 4,128,083 | | 12/1978 | Bock . | |

* cited by examiner

*Primary Examiner*—Michael Koczo
(74) *Attorney, Agent, or Firm*—Kilpatrick & Stockton LLP

(57) ABSTRACT

The invention relates to a multi-piston hydraulic pump for a free-piston engine, comprising two engine pistons (2) mounted on a common piston rod (1) which is also fitted with pin-shaped pistons (5*a*, 5*b*) of the hydraulic pump at a radial distance from the piston rod (1). Mounting blocks (6*a*,6*b*) for the hydralic punp pistos (5*a*, 5*b*) extend from the engine piston rod (1) crosswise relative to each other at an axial distance from each other. The hydraulic pistons (5*a* and 5*b*) fastened to different mounting blocks (6 and 6*b* and 6*b*) are located for the most part side by side over the same section of the axial length of the engine piston rod and the free ends thereof point in opposite directions.

2 Claims, 1 Drawing Sheet

MULTI-PISTON HYDRAULIC PUMP FOR A FREE PISTON ENGINE

The present invention relates to a multi-piston hydraulic pump for a free-piston engine, comprising two engine pistons mounted on a common piston rod which is also fitted with pin-shaped pistons of the hydraulic pump at a radial distance from the piston rod, and mounting blocks for the hydraulic pump pistons extend from the engine piston rod at a distance from each other and the free ends of the hydraulic pistons point in opposite directions.

This type of free-piston engine with its multi-piston hydraulic pump is prior known from the Patent publication U.S. Pat. No. 4,097,198. An object of the invention is to improve this prior known mechanism in view of optimizing the space utilization of a hydraulic pump and, thus, for reducing the overall length of an engine.

This object is achieved by the invention on the basis of the characterizing features set forth in the appended claim 1.

The invention is further capable of achieving the additional advantage that the mounting blocks of hydraulic pump pistons can be used as pistons for the scavenger pumps of engine cylinders.

Figure 1:
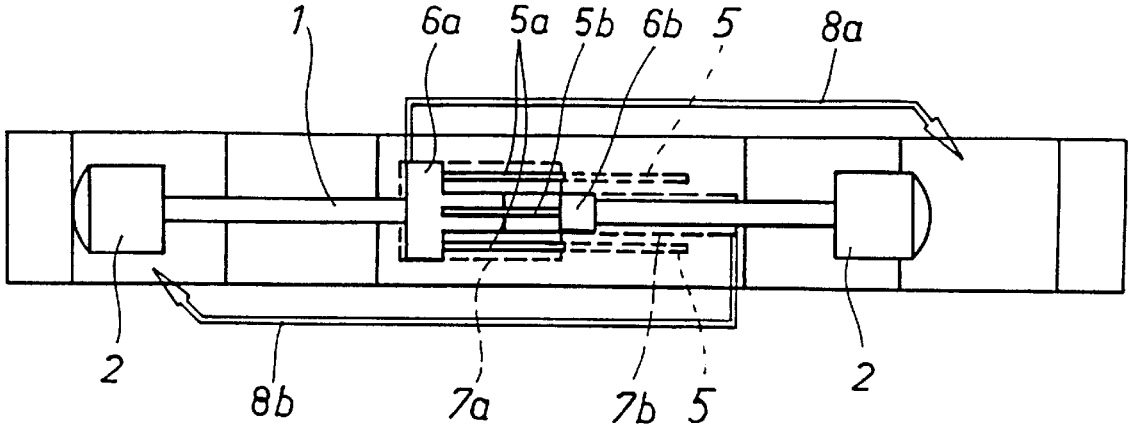
Figure 2:
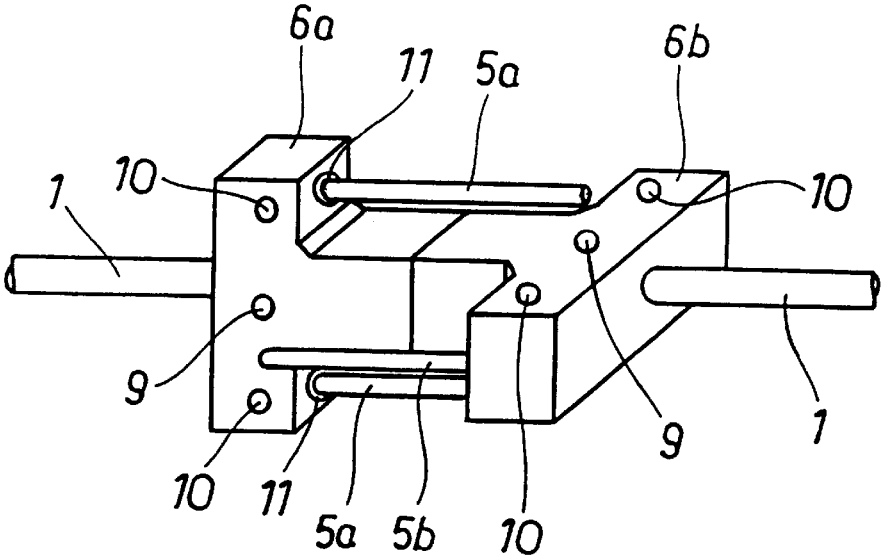

The invention will now be described in more detail with reference made to the accompanying drawings, in which FIG. 1 shows schematically a free-piston engine including a multi-piston hydraulic pump of the invention, and FIG. 2 is a perspective view showing the hydraulic pump pistons with mounting blocks therefor.

A free-piston engine includes two engine pistons 2 mounted on the opposite ends of a piston rod 1. The piston rod 1 has its mid-section provided with axially spaced scavenger pump pistons 6*a* and 6*b*, which are T-shaped blocks whose T-stems are parallel and against each other and T-heads are crosswise, in the present case at an angle of 90° relative to each other. Pin-shaped hydraulic pump pistons 5*a* are fastened to the mounting block 6*a*. Respectively, two hydraulic pump pistons 5*b* are fastened to the mounting block 6*b*. The hydraulic pistons 5*a* and 5*b* fastened to different mounting blocks 6*a* and 6*b* are located for the most part side by side over the same section of the axial length of the engine piston rod 1 and the free ends of pistons 5*a* point in the direction opposite to that of the free ends of pistons 5*b*. By virtue of this arrangement, it is possible to employ a multi-piston hydraulic pump having a length which is as short as possible. Naturally, the number of pistons 5*a* and 5*b* may vary.

The mounting blocks 6*a* and 6*b* of the hydraulic pistons can also be used for another purpose. They can also serve as pistons for the scavenger pumps of engine cylinders. In this case, the scavenger pump pistons constituted by blocks 6*a* and 6*b* operate in cylinder spaces 7*a* and 7*b* made in the engine body, said spaces being connected by way of scavenging ducts 8*a* and 8*b* to respective engine cylinders.

The piston rod 1 extends through holes bored centrally in blocks 6*a* and 6*b* and the blocks 6*a* and 6*b* are fastened to the piston rod 1 by means of crosswise fastening pins 9. The pin pistons 5*a* and 5*b* are secured to blocks 6*a* and 6*b* by means of crosswise fastening pins 10. Receiving holes 11 for the bases of pin pistons 5*a* and 5*b* are made loose and filled with resilient packings, whereby the pin pistons 5*a* and 5*b* are able to find their way into pump cylinders 5 without setting unreasonably strict tolerances for manufacturing.

What is claimed is:

1. A free piston engine driving a hydraulic pump comprising:

two engine pistons (2) mounted on a common piston rod (1), mounting blocks (6*a*, 6*b*) extending radially from the engine piston rod and axially spaced from each other, pin-shaped hydraulic pump pistons (5*a*, 5*b*) integral with the mounting blocks (6*a*, 6*b*) and parallel to the axis of the common piston rod (1), the hydraulic pump pistons (5*a*, 5*b*) extending in opposite directions from the respective mounting blocks, characteized in that the mounting blocks (6*a*, 6*b*) of the hydraulic pump pistons extend crosswise relative to each other and that the hydraulic pistons (5*a*, 5*b*) fastened to different mounting blocks (6*a*, 6*b*) are located for the most part side by side over the same section of the axial length of the common piston rod (1).

2. A hydraulic pump as set forth in claim 1, characterized in that said mounting blocks (6*a*, 6*b*) of the hydraulic pump pistons serve at the same time as pistons for the scavenger pumps of engine cylinders, having their cylinder aspaces (7*a*, 7*b*) connected by way of scavenging ducts (8*a*, 8*b*) to respective engine cylinders.

* * * * *